US010569293B2

(12) United States Patent
Pozzi et al.

(10) Patent No.: US 10,569,293 B2
(45) Date of Patent: Feb. 25, 2020

(54) DOCTOR BLADE HANDLING SYSTEM

(71) Applicant: IPCO Sweden AB, Sandviken (SE)

(72) Inventors: Raffaele Pozzi, Limbiate (IT); Fiorenzo Zarantonello, Somma Lombardo (IT)

(73) Assignee: IPCO Sweden AB, Sandviken (SE)

( * ) Notice: Subject to any disclaimer, the term of this patent is extended or adjusted under 35 U.S.C. 154(b) by 301 days.

(21) Appl. No.: 15/533,221

(22) PCT Filed: Oct. 7, 2015

(86) PCT No.: PCT/IB2015/002103

§ 371 (c)(1),
(2) Date: Jun. 5, 2017

(87) PCT Pub. No.: WO2016/055859

PCT Pub. Date: Apr. 14, 2016

(65) Prior Publication Data

US 2017/0348723 A1 Dec. 7, 2017

Related U.S. Application Data

(60) Provisional application No. 62/060,633, filed on Oct. 7, 2014.

(51) Int. Cl.
*B08B 1/02* (2006.01)
*D21G 3/00* (2006.01)
(Continued)

(52) U.S. Cl.
CPC ..... *B05C 11/026* (2013.01); *B05C 11/04* (2013.01); *B08B 1/02* (2013.01); *D21G 3/005* (2013.01); *A24B 3/14* (2013.01)

(58) Field of Classification Search
CPC ..... B08B 1/02; B05C 11/04; D21G 3/005
See application file for complete search history.

(56) References Cited

U.S. PATENT DOCUMENTS 4,691,406 A 9/1987 Goodnow et al.
5,007,132 A 4/1991 Reid et al.
(Continued)

FOREIGN PATENT DOCUMENTS

CN 200998706 Y 1/2008
CN 102649624 A 8/2012
CN 203738377 U 7/2014

OTHER PUBLICATIONS

First Office Action issued in corresponding Chinese Patent Application No. 201580066373.1, dated Mar. 20, 2019.

*Primary Examiner* — Randall E Chin
(74) *Attorney, Agent, or Firm* — Morgan, Lewis & Bockius LLP

(57) ABSTRACT

A doctoring apparatus has a flexible doctor blade advanced longitudinally across a surface being doctored. The doctor blade is feed in a continuous length from a storage cartridge and sequentially supported in a blade holder to apply the blade to a moving surface to be doctored. One or both of a pneumatic blade advancing device and a pneumatically operated clamping system are opened and closed in timed sequence with reciprocation of the blade holder longitudinally shifting the doctor blade in a selected direction across the doctored surface. The pneumatic blade advancing device includes an idler roller and a powered roller that co-operate to indexingly advance the doctor blade along the blade path. The clamping system includes a blade cutter to cut the doctor blade and that drives the cut off end of the doctor blade into a discard container.

14 Claims, 12 Drawing Sheets

(51) Int. Cl.

| | |
|---|---|
| ***B05C 11/02*** | (2006.01) |
| ***B05C 11/04*** | (2006.01) |
| *A24B 3/14* | (2006.01) |

(56) References Cited

U.S. PATENT DOCUMENTS

| | | | | | |
|---|---|---|---|---|---|
| 5,066,364 | A | * | 11/1991 | Goodnow ..... | D21G 3/005 15/256.53 |
| 5,138,740 | A | | 8/1992 | Goodnow et al. | |
| 5,230,775 | A | * | 7/1993 | Goodnow ..... | D21G 3/005 15/256.51 |
| 5,264,035 | A | | 11/1993 | Beisswanger et al. | |
| 5,782,976 | A | | 7/1998 | Marziale et al. | |
| 2003/0089208 | A1 | | 5/2003 | Sovijarvi | |

* cited by examiner

DOCTOR BLADE HANDLING SYSTEM

RELATED APPLICATION DATA

This application is a § 371 National Stage Application of PCT International Application No. PCT/IB2015/002103 filed Oct. 7, 2015 claiming priority of US Application No. 62/060,633, filed Oct. 7, 2014.

FIELD OF THE DISCLOSURE

The present disclosure relates to a doctoring apparatus having a flexible doctor blade that is advanced longitudinally across a surface being doctored. More specifically, the present disclosure relates to continuously feeding a flexible doctor blade longitudinally through a blade holder to one or more of a pneumatic blade advancing device and a pneumatically operated clamping system, each of which operate in timed sequence with reciprocation of the blade holder, to achieve, longitudinal shifting of the doctor blade in a selected direction across the doctored surface and to cut the free-end of the used doctor blade for disposal.

BACKGROUND

In the discussion that follows, reference is made to certain structures and/or methods. However, the following references should not be construed as an admission that these structures and/or methods constitute prior art. Applicant expressly reserves the right to demonstrate that such structures and/or methods do not qualify as prior art against the present invention.

Doctor blades are used in many coating operations, including to level or remove excess material from a surface being coated and in releasing operations applied to products casted in thin layers (for example, tobacco). Typically, the angle of contact is controlled to achieve the desired result. Oscillation of the doctor blade, usually by oscillation of the entire doctor blade assembly, contributes to more even wear and more even coating as well as to an effective product release.

Typically, doctor blades are made of an inexpensive material and are replaced as they wear. Replacement can be by removal of the blade, usually removal of a blade and its holder (as in a so-called "cut-to-length" system), or by continuous or intermittent feeding of an elongated doctor blade to a blade holder (as in a so-called "pull through" system"). When fed continuously, the elongated doctor blade is typically unwound from a supply reel, fed into a blade holder, and wound on a take-up reel. Clamping systems operate to hold the doctor blade in operative position and also to advance the elongated doctor blade from supply reel to take-up reel. When the trailing end of one elongated doctor blade leaves the supply reel, the now empty reel is removed and replaced by a new supply reel containing a fresh coil of elongated doctor blade and, after any initial set up, the operation of the apparatus continued. Representative doctor blades and "pull through" system" doctor blade apparatus are disclosed in U.S. Pat. Nos. 5,007,132; 5,138,740, 5,264,035; and 5,782,976, the entire contents of which are incorporated herein by reference.

SUMMARY

It is desirable to improve the doctoring apparatus for pull through systems with doctor blade feeding and clamping systems. For example, it is desirable to make improvements and introduce innovations in doctor blades that reduce lost production time and simplify the exchange or replacement of supply reels containing a fresh coil of elongated doctor blade to allow a nearly continuous mode of operation of the doctoring apparatus.

An exemplary embodiment of a pull through doctor blade handling system comprises means for mounting a supply source for an elongated doctor blade, a blade holder including a blade back with a seat for releasably holding a portion of the doctor blade, a pneumatic multi-position cylinder unit including a blade clamp and a blade cutter, a blade path for the doctor blade, the blade path running from proximate the means for mounting the supply source, through the blade holder, and to the pneumatic multi-position cylinder unit, and an oscillation system operably connected to the blade holder to translate the blade holder, relative to the blade path, reciprocatingly between a first position and a second position, wherein, in the first position, the blade holder is operably proximate a portion of a surface to be coated, and wherein, in the second position, the blade holder is closer to the blade clamp than in the first position.

Another exemplary embodiment of a pull through doctor blade handling system comprises means for mounting a supply source for an elongated doctor blade, a blade holder including a blade back with a seat in which a portion of the doctor blade is positioned, a pneumatic blade advancing device including an idler roller and a powered roller, a pneumatic multi-position cylinder unit including a blade clamp and a blade cutter, a blade path for the doctor blade, the blade path running from proximate the means for mounting the supply source, through the blade holder, through the pneumatic blade advancing device and to the pneumatic multi-position cylinder unit, and a biasing system operably connected to the blade holder to move an edge of the doctor blade seated in the blade holder between a biased position and an unbiased position, wherein, in the biased position, the edge of the doctor blade is in force-exerting contact with a surface to be doctored, an oscillation system operably connected to the blade holder to translate the blade holder, relative to the blade path, reciprocatingly between a first position and a second position, wherein, in the first position, the blade holder is operably proximate a portion of a surface to be coated, and, in the second position, the blade holder is closer to the blade clamp than in the first position, and wherein the idler roller and the powered roller are translatable, relative to each other, between a closed position in which surfaces of the idler roller and the powered roller exert a pressure to the doctor blade and an open position in which the surface of at least one of the idler roller and the powered roller is spaced apart from the doctor blade.

An exemplary method of advancing a pull through doctor blade longitudinally across a surface being doctored by a series of translations of a blade holder comprises the steps of: (a) frictionally engaging a first portion of an elongated, continuous doctor blade with the blade holder, (b) translating the blade holder in a first direction to pay out the elongated, continuous doctor blade from a supply source and to extend a free end of the doctor blade through a cutting zone of a blade cutter, (c) clamping the elongated, continuous doctor blade in a blade clamp, (d) cutting off a free end of the doctor blade with the blade cutter, (e) translating the blade holder in a second direction to slidably move the blade holder from frictionally engaging the first portion of the doctor blade to frictionally engaging a second portion of the doctor blade, and (e) unclamping the doctor blade in the blade clamp.

Another exemplary method of advancing a pull through doctor blade longitudinally across a surface being doctored comprises the steps of (a) biasing the blade holder to be in force-exerting contact with a surface to be doctored, wherein the force imparted to the doctor blade frictionally engages the doctor blade with a seat of the blade holder, (b) translating the blade holder in a first direction from a first position to a second position to pay out the elongated, continuous doctor blade from a supply source and to advance a portion of the doctor blade into a clamping zone of a pneumatic blade advancing device, (c) clamping the elongated, continuous doctor blade in a stationary position relative to a blade path of the doctor blade, (d) unbiasing the doctor blade, and (e) translating the blade holder in a second direction to slidably move the doctor blade relative to the seat of the blade holder as the blade holder moves from the second position toward the first position.

A further exemplary method of advancing a pull through doctor blade longitudinally across a surface being doctored comprises the steps of (a) removing or reducing frictional contact between a doctor blade and a blade seat of the blade holder by removing or reducing a bias on a blade holder to remove or reduce a force-exerting contact between a portion of the doctor blade and a surface to be doctored, (b) placing a pneumatic blade advancing device in a closed position, wherein, in the closed position, surfaces of an idler roller and a powered roller exert a pressure to the doctor blade, (c) rotating the powered roller of the pneumatic blade advancing device to move the doctor blade along the blade path and through the blade seat of the blade holder a length sufficient to position a new portion of doctor blade to be in contact with the surface to be doctored, and (d) biasing the blade holder to establish a force-exerting contact between a portion of the doctor blade and a surface to be doctored, wherein the force imparted to the doctor blade frictionally engages the doctor blade with a seat of the blade holder.

BRIEF DESCRIPTION OF THE DRAWING

The following detailed description of preferred embodiments can be read in connection with the accompanying drawings in which like numerals designate like elements and in which.

DETAILED DESCRIPTION

Figure 1A:
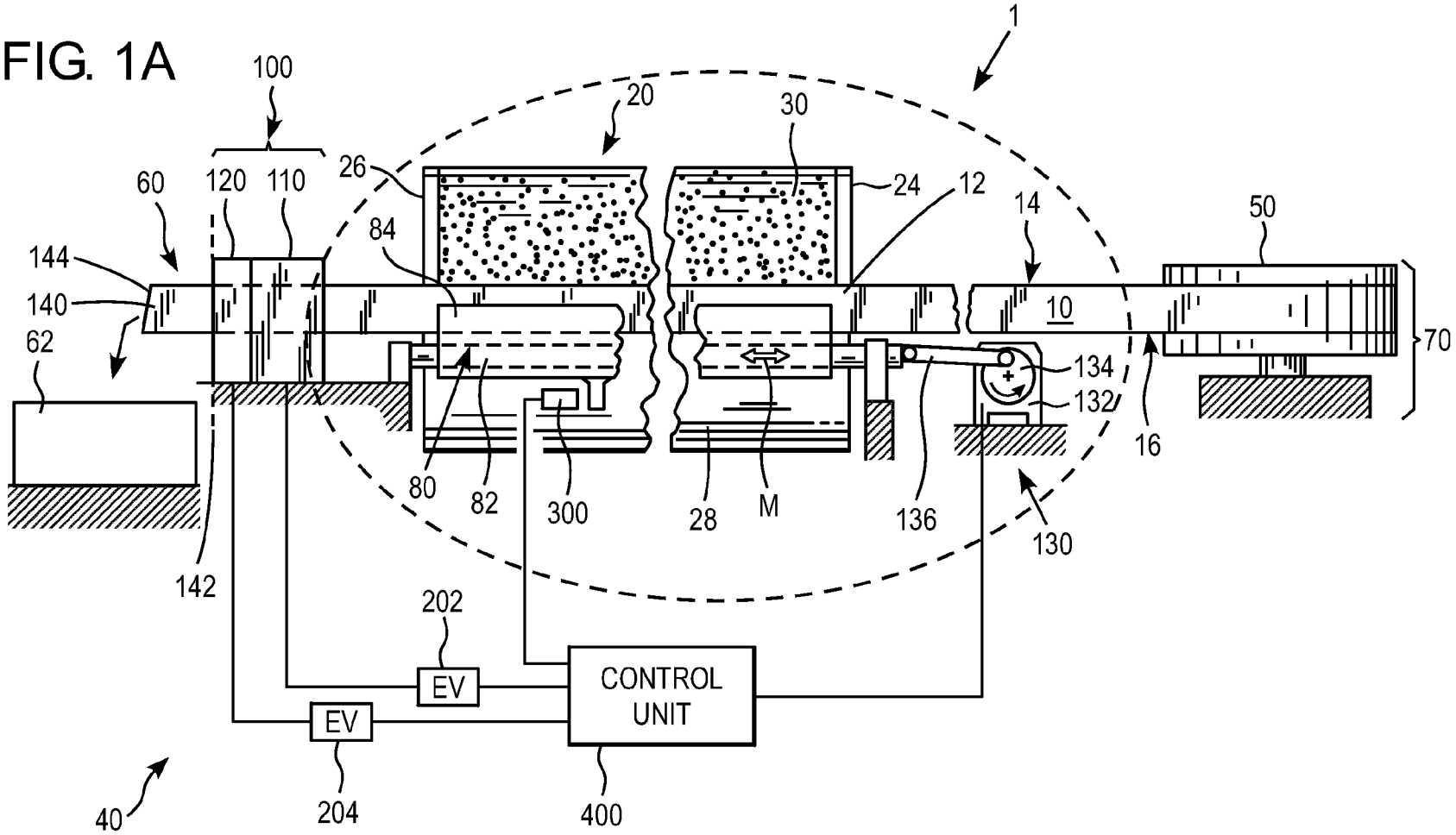
FIG. 1A shows a schematic illustration of an exemplary embodiment of a pull through doctor blade transfer apparatus
Figure 1B:
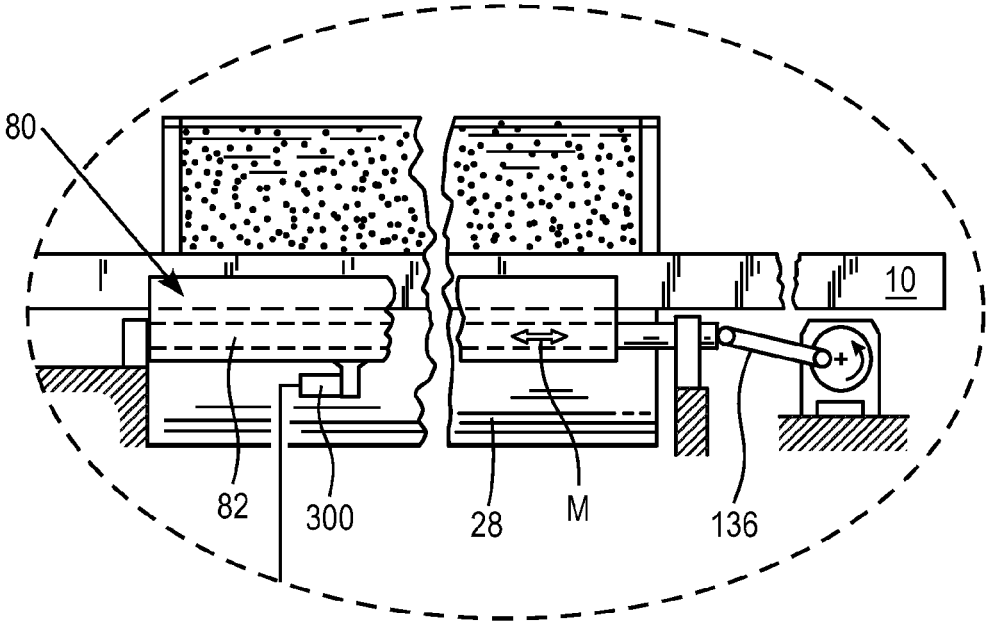
FIG. 1B shows a portion of the apparatus from FIG. 1A where the blade holder has been translated to a second position.

A schematic illustration of an exemplary embodiment of a doctor blade handling system in a doctoring apparatus is shown in FIGS. 1A and 1B. The exemplary embodiment of the doctoring apparatus 1 comprises an elongated and continuous doctor blade 10, a rotating cylinder 20 rotatable on axis and having a first axial end 24 and a second axial end 26 and a circumferential surface 28 on which the surface to be doctored 30 is located, and a doctor blade handling system 40. The illustrated doctor blade handling system 40 is of the "pull through" type.

The elongated and continuous doctor blade 10 is generally sufficiently flexible to be wound along a blade path from a supply source 50, through intermediate features of the doctoring apparatus 1 including features of the doctor blade handling system 40, to a discharge end 60. As seen in FIGS. 1A and 1B, the elongated, continuous doctor blade 10 positioned in the example blade path extends past the first and second axial ends 24,26 of the rotating cylinder 20. By extending past the axial ends, the doctor blade 10 is assured of being in position for doctoring processes on any portion of the rotating cylinder 20, including if the entire rotating cylinder 20 is the surface to be doctored 30. Furthermore, flexibility of the doctor blade 10 allows the doctor blade 10 to be compactly stored in the supply source 50. For example, the doctor blade can be coiled onto a blade cartridge or can be serpentinely layered in a container for unconstrained removal and feeding to the doctor blade handling system 40.

A collection device can be positioned at the discharge end 60 to collect the doctor blade 10, or portions of the doctor blade 10, as they are cut discharged. In FIG. 1A, the collection device is illustrated as a box 62, but any container can be used as long as it is capable of being suitably positioned and has a suitable size and capacity to hold the cut off ends of the doctor blade 10 that are formed at the discharge end 60 of the doctor blade handling system 40.

The doctor blade handling system 40 will now be described further in connection with FIGS. 1A, 1B and 2. Exemplary embodiments of the doctor blade handling system 40 comprise means for mounting 70 a supply source for an elongated, continuous doctor blade 10, a blade holder 80 including a blade back 82 and a blade seat 84 for releasably holding a portion of the doctor blade 10; a pneumatic multi-position cylinder unit 100 including a blade clamp 110 and a blade cutter 120, and an oscillation system 130 operably connected to the blade holder 80. Within the pull through doctor blade handling system 40, the blade path runs from proximate the means for mounting 70 the supply source, through the blade holder 80, and to the pneumatic multi-position cylinder unit 100.

Means for mounting 70 a supply source for the doctor blade 10 can be any suitable means 70 on which a supply source 50 can rest and which facilitates the supply of the doctor blade 10 to the doctor blade handling system 40. For example, for supply sources that have wound doctor blades, means for mounting can be a spindle or other rotatable device and can include a mating feature at a distal end to facilitate attachment of the supply source, rotation of the supply source, and the transfer of any rotational motion to the supply source. In another example, for supply sources that have layered or serpentine storage of doctor blades, means for mounting can be a surface for a container and a moving arm to guide the doctor blade being pulled from the supply source by the doctor blade handling system and to minimize tangling. In a specific example, the supply source is in the form a rotatable reel doctor blade cartridge attached to a means for mounting the supply source in the form of a rotatable spindle attached to a motor for powered rotation and tensioning. Attachment can be by mating correspondingly shaped male and female features or threaded features on the distal tip of the spindle and in the cartridge.

As seen in FIGS. 1A and 1B, blade holder 80 extends longitudinally in a common direction with the blade path as it traverses the rotating cylinder 20 in a desired orientation for doctoring. It will be understood that the rotating cylinder depicted in FIGS. 1A and 1B can be replaced by other surfaces to be doctored, such as a surface on a shifting belt. In the illustrated example, the blade holder 80 is oriented in the axial direction from the first axial end 24 to the second axial end 26. The blade holder 80 has a blade back 82 in a first portion and a blade seat 84 in a second portion. The blade seat 84 releasably holds a portion of the doctor blade 10, e.g., an intermediate portion 12 of the doctor blade 10, with a suitable orientation with respect to the surface being doctored 30 to apply or manipulate the coating or other material in the doctoring process. In an exemplary embodiment, the blade seat 84 can incorporate a slit with opposing surfaces and the intermediate portion 12 of the doctor blade 10 can be held in the blade seat 84 in a releasable friction fit between the intermediate portion 12 and the opposing surfaces of the slit. The friction fit results from, for example, the thickness of the doctor blade 10 being larger than the corresponding width of the slit, e.g., the separation distance between opposing surfaces of the slit, or, in alternative example, in the width of the slit being adjustable such that it releasably contacts the intermediate portion 12 of the doctor blade 10 to form a friction fit and then releases the intermediate portion 12 during reciprocation of the blade holder 80 (discussed further herein). The blade holder 80 applies a working edge 14 of an intermediate portion 12 of the doctor blade 10 to the surface being doctored 30. The doctor blade 10 has a bottom edge 16 which is parallel to a working edge 14 and which is supported in the blade holder 80. The blade back 82 is adjustable to urge the blade holder 80 towards the rotating cylinder 20, thus applying the working edge 14 of the doctor blade 10 to the surface to be doctored 30 in a suitable manner.

Relative to the blade path, the blade holder 80 reciprocates between a first position (an example of which is shown in FIG. 1A) and a second position (an example of which is shown in FIG. 1B) in the direction indicated by arrow M. In the first position, the blade holder 80 is operably proximate a portion of a surface to be coated 30 with the blade holder 80 positioned axially between the first and second axial ends 24, 26 of the rotating cylinder 20. In the second position, the blade holder 80 has moved downstream (relative to the direction of motion of the blade path from supply source 50 to discharge end 60). In the exemplary embodiment shown, when the blade holder 80 moves in the downstream direction, the second position of the blade holder 80 is closer to the discharge end 60 than is the first position. Alternatively, in the second position the blade holder 80 is proximate the circumferential surface of the rotating cylinder 20 with at least a portion of the blade holder 80 positioned axially outside one of the first and second axial ends 24,26 of the rotating cylinder 20.

An oscillation system 130 is operably connected to the blade holder 80 to cause reciprocating translation motion. In the exemplary embodiment of FIGS. 1A and 1B, the oscillation system 130 includes an electric drive system with an electric gear motor 132 provided with a crank throw 134 and a connecting rod 136. This connecting rod 138 is directly connected to the blade holder 80. When electric gear motor 132 operates, the crank throw 134 rotates and the connecting rod 136 reciprocates, causing reciprocating motion in the connected blade holder 80 and its associated features.

Figure 2:
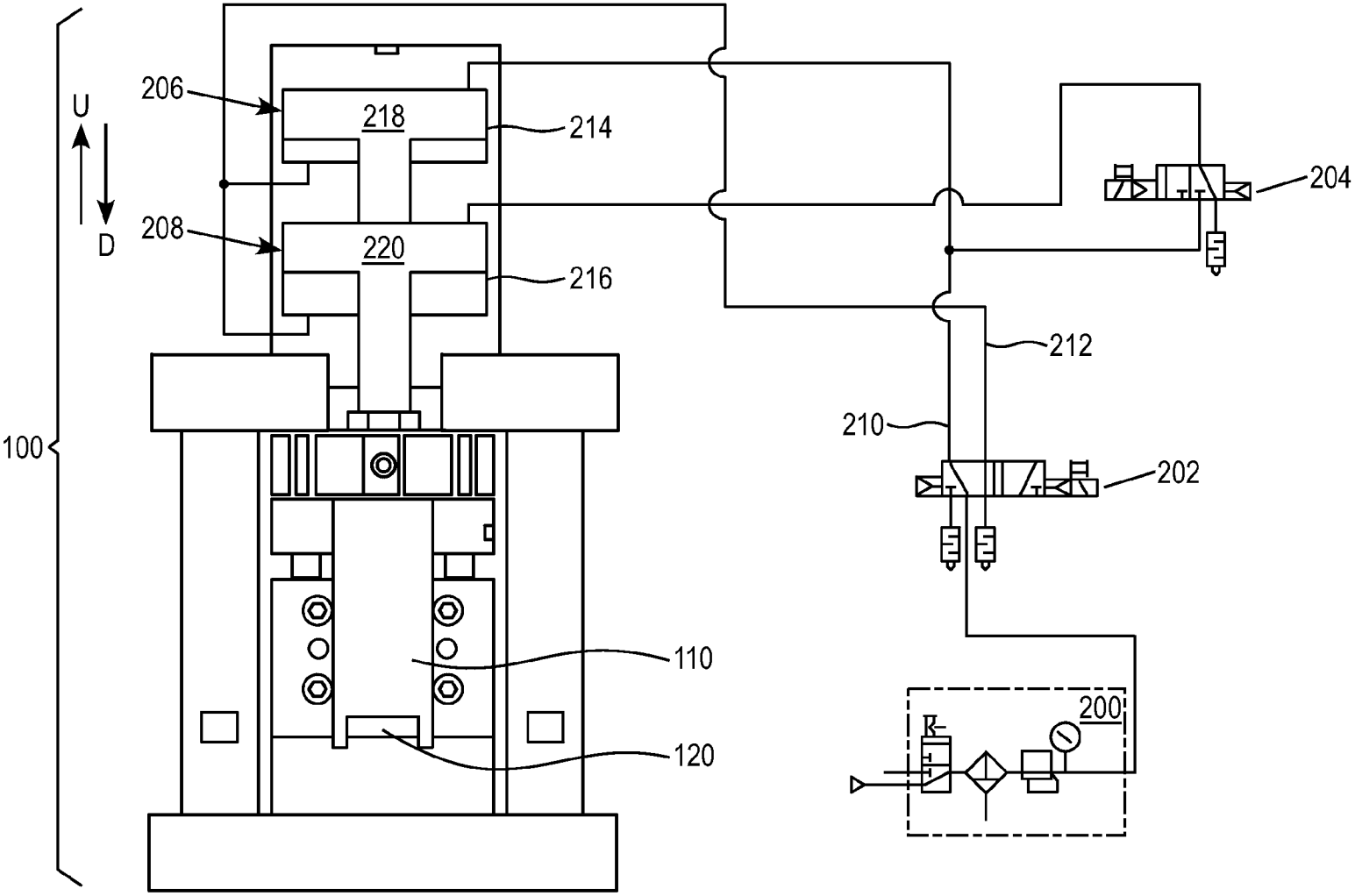
FIG. 2 shows a schematic illustration of an exemplary embodiment of a blade clamp and blade cutter system to clamp and cut a doctor blade.

An exemplary embodiment of a pneumatic multi-position cylinder unit is illustrated in FIG. 2. The pneumatic multi-position cylinder unit 100 includes a blade clamp 110 and a blade cutter 120. The blade clamp 110 can be pneumatically actuated and is arranged to act on a continuing portion of the doctor blade 10 and is operable between a closed position in which a surface of the blade clamp contacts the doctor blade with sufficient force that relative translational movement between the doctor blade 10 and the surface to be doctored 30 is prevented and an open position in which such relative movement is permitted. The blade cutter 120 can also be pneumatically actuated and is arranged to act on a portion 140 of the doctor blade 10 that extends past a cutting zone 142 and presents a free end 144 of the continuous doctor blade 10. In an open position of the blade cutter 120, the doctor blade 10 can be freely moved through a cutting zone 142; in a closed position of the blade cutter 120, the cutting blade has traversed through the cutting zone 142 and separated, e.g., cut, the portion 140 from the doctor blade 10, which portion 140 is then collected for discarding.

Also illustrated in the exemplary embodiment of a pneumatic multi-position cylinder unit in FIG. 2 is the arrangement to operate the blade clamp 110 and a blade cutter 120. The arrangement includes master valve 200 and electrically operated pneumatic valves 202, 204 in communication with pneumatic operated pistons 206,208 via one or more pneumatic lines 210,212. Pneumatic line 210 is in fluid communication with chambers 214,216 for the piston head at a location that is above the respective piston head 218,220 and pneumatic line 212 is in fluid communication with chambers 214,216 for the piston head at a location that is below the respective piston head 218,220. Thus, supplying pressure to pneumatic line 210 while venting pneumatic line 212 establishes a differential pressure across the respective piston head 218,220 to move the pistons 206,208 in a first direction D, equivalent to downward in FIG. 2, and supplying pressure to pneumatic line 212 while venting pneumatic line 210 establishes a differential pressure across the respective piston head 218,220 to move the pistons 206,208 in a second direction U, equivalent to upward in FIG. 2. This pneumatic operation provides the actuation of blade clamp 110 and blade cutter 120, either sequentially or simultaneous depending on the control of the electrically operated pneumatic valves 202, 204. Although discussed here using the term pneumatic and implying a gas or air operated system, it should be understood that the relevant features and operation are not limited to gas or air operation but could also be implemented with features and operation based on hydraulics, i.e., a fluid operated system, or with a combination of pneumatic and hydraulic features.

Exemplary embodiments of a pull through doctor blade handling system 40 also include a sensor 300 proximate the blade holder 80 and a control unit 400 operably connected to the oscillation system 130, the pneumatic multi-position cylinder unit 100 and the sensor 300. An example of a sensor 300 is an inductive switch. In exemplary embodiments, the sensor 300 discriminates between the blade holder 80 located in the first position and the blade holder 80 not in the first position or, for example, located in the second position.

The blade clamp 110 is opened and closed in timed sequence with reciprocation of the blade holder 80 to achieve longitudinal shifting of the doctor blade 10 in a selected direction across the doctored surface, from supply source 50 to discharge end 60. Additionally, the blade clamp 110 and blade cutter 120 can be used to clamp and to cut the worn doctor blade. The blade cutter 120 can also be used to drive the cut-off portion 140 of the doctor blade into the collection device.

The control unit 400 coordinates the operation and sequence of the oscillation system 130, the blade holder 80 and the pneumatic multi-position cylinder unit 100, based on position information communicated from the sensor 300. The operations and sequence include:

(i) moving the blade holder 80 from the first position to the second position, (ii) moving the blade clamp 110 to the clamping position, (iii) cycling the blade cutter 120 between the open position and the cutting position, (iv) moving the blade holder 80 from the second position to the first position, and (iv) moving the blade clamp 110 to the open position.

Moving the blade holder 80 from the second position to the first position before moving the blade clamp 110 to the open position, e.g., before unclamping the doctor blade 10 from blade clamp 110, slidably moves the blade holder 80 from frictionally engaging a first portion of the doctor blade 10 to frictionally engaging a second portion of the doctor blade 10. In this way, the doctor blade 10 is longitudinal shifted in a selected direction across the surface to be doctored 30.

In a more detailed description of the operation of the embodiment in FIGS. 1A and 1B, the blade holder 80 shifts from the first position to the second position (the second position downstream in a direction of the blade path from the first position) and sensor 300 communicates positional information of the blade holder 80 to the control unit 400, which is connected to the solenoid of the pneumatic valves 202, 204. In the illustrated configuration in FIG. 2, valve 202 is operated first then valve 204 is operated. By this staggered operation, pneumatic fluid is first supplied to chamber 214 and then to chamber 216 of pneumatic multi-position cylinder unit 100. As a consequence of this sequencing, the blade clamp 110 is closed first, then the blade cutter 120 is actuated to cut the doctor blade 10. Typically, actuation of the blade cutter 120 cycles from open to closed and returns to the open position. When the blade holder 80 is shifted in the opposite direction and back to the first position, the doctor blade 10 is prevented from moving by the still closed blade clamp 110, thus shifting the doctor blade 10 relative to the blade holder 80. Once returned to the first position, the sensor 300 updates the control unit 400, which operates the pneumatic valve 202 to cause the blade clamp 110 to actuate to the open position. When the next stroke of the oscillation system 130 occurs, the blade path is again open and the blade holder 80 will move again to the second position while frictionally engaged with the doctor blade 10 and pull the doctor blade 10 forward on the blade path. In this way, the doctor blade 10 is incrementally shifted longitudinally across the cylinder 20 from a supply source 50 to a discharge end 60.

During doctoring operation, the blade holder 80 is oscillated by the oscillation system, and the blade clamp 110 and blade cutter 120 are employed in timed sequence with this oscillation to shift the doctor blade 10 longitudinally and in an indexed-like fashion across the surface of the cylinder 20, with doctor blade 10 being gradually pulled from supply source 50 and cut-off by blade cutter 120 and collected in collection device, such as box 62. The handling system allows for the continuous or nearly continuous supply and disposal of the doctor blade.

When a first doctor blade 10 has been passed through the doctor blade handing system 40 and the trailing end of the doctor blade leaves the supply source 50, that supply source 50 is replaced by a new one containing a second doctor blade 10. This having been accomplished, the doctoring operation is momentarily interrupted, the blade clamp 110 and blade cutter 120 are set to an open position and the leading end of the second doctor blade 10 is then advanced by the operator along the blade path through the blade clamp 110 and blade cutter 120. The second doctor blade 10 is also attached to the blade holder 80. Then the doctoring operation is continued and, when full, the collection device containing the cut pieces of doctor blade is replaced by an empty one.

Figure 3:
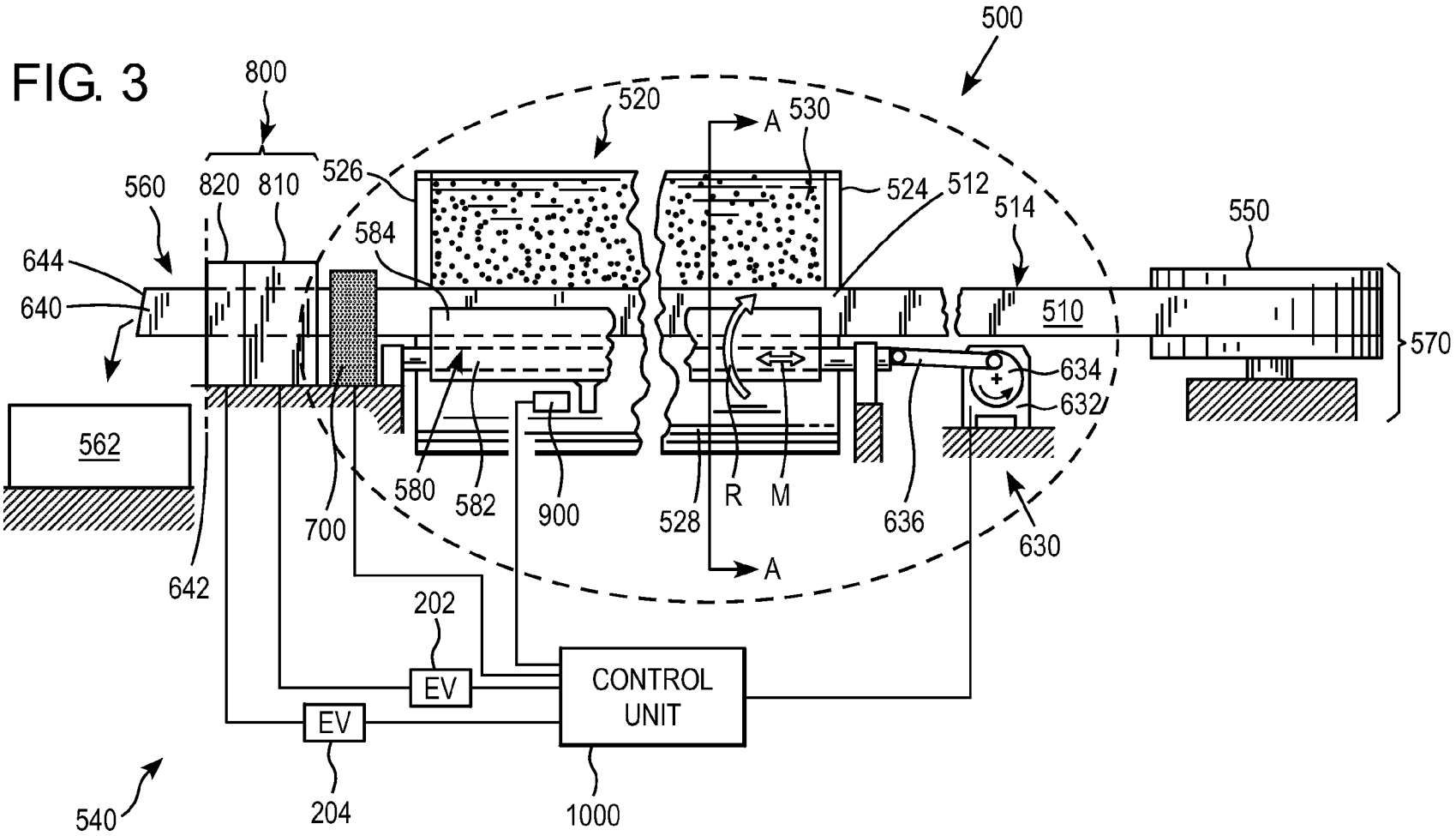
FIG. 3 shows a schematic illustration of another exemplary embodiment of a pull through doctor blade transfer apparatus.

A schematic illustration of another exemplary embodiment of a doctor blade handling system in a doctoring apparatus is shown in FIG. 3. The exemplary embodiment of the doctoring apparatus 500 comprises an elongated and continuous doctor blade 510, a rotating cylinder 520 rotatable on an axis and having a first axial end 524 and a second axial end 526 and a circumferential surface 528 on which the surface to be doctored 530 is located, and a doctor blade handling system 540. The illustrated doctor blade handling system 540 is of the "pull through" type.

The elongated and continuous doctor blade 510 is generally sufficiently flexible to be wound along a blade path from a supply source 550, through intermediate features of the doctoring apparatus 500 including features of the doctor blade handling system 540, to a discharge end 560. As seen in FIG. 3, the elongated, continuous doctor blade 510 positioned in the example blade path extends past the first and second axial ends 524,526 of the rotating cylinder 520. By extending past the axial ends, the doctor blade 510 is assured of being in position for doctoring processes on any portion of the rotating cylinder 520, including if the entire rotating cylinder 520 is the surface to be doctored 530. Furthermore, flexibility of the doctor blade 510 allows the doctor blade 510 to be compactly stored in the supply source 550. For example, the doctor blade can be coiled onto a blade cartridge or can be serpentinely layered in a container for unconstrained removal and feeding to the doctor blade handling system 540.

A collection device can be positioned at the discharge end 560 to collect the doctor blade 510, or portions of the doctor blade 510, as they are cut and discharged. In FIG. 3, the collection device is illustrated as a box 562, but any container can be used as long as it is capable of being suitably positioned and has a suitably size and capacity to hold the cut off ends of the doctor blade 510 that are formed at the discharge end 560 of the doctor blade handling system 540.

An exemplary doctor blade handling system 540 will now be described further in connection with FIGS. 3, 4A-B and 5A-B. Exemplary embodiments of the doctor blade handling system 540 comprise means for mounting 570 a supply source for an elongated, continuous doctor blade 510, a blade holder 580 including a blade back 582 and a blade seat 584 for releasably holding a portion of the doctor blade 510; a pneumatic blade advancing device 700 including an idler roller 710 and a powered roller 720, and an oscillation system 630 operably connected to the blade holder 580. Within the pull through doctor blade handling system 540, the blade path runs from proximate the means for mounting 570 the supply source, through the blade holder 580, and to pneumatic blade advancing device 700. An optional pneumatic multi-position cylinder unit 100 including a blade clamp 110 and a cutter blade 120 (as described in connection with the embodiment shown and described in connection with FIGS. 1A-B and 2) can be included in the doctor blade handling system 540 and in the blade path, in particular after the pneumatic blade advancing device 700 and towards or as part of the discharge end 560 of the blade path.

Means for mounting 570 a supply source for the doctor blade 510 can be any suitable means 570 on which a supply source 550 can rest and which facilitates the supply of the doctor blade 510 to the doctor blade handling system 540. For example, for supply sources that have wound doctor blades, means for mounting can be a spindle or other rotatable device and can include a mating feature at a distal end to facilitate attachment of the supply source, rotation of the supply source, and the transfer of any rotational motion to the supply source. In another example, for supply sources that have layered or serpentine storage of doctor blades, means for mounting can be a surface for a container and a moving arm to guide the doctor blade being pulled from the supply source by the doctor blade handling system and to minimize tangling. In a specific example, the supply source is in the form a rotatable reel doctor blade cartridge attached to a means for mounting the supply source in the form of a rotatable spindle attached to a motor for powered rotation and tensioning. Attachment can be by mating correspondingly shaped male and female features or threaded features on the distal tip of the spindle and in the cartridge.

Figure 4A:
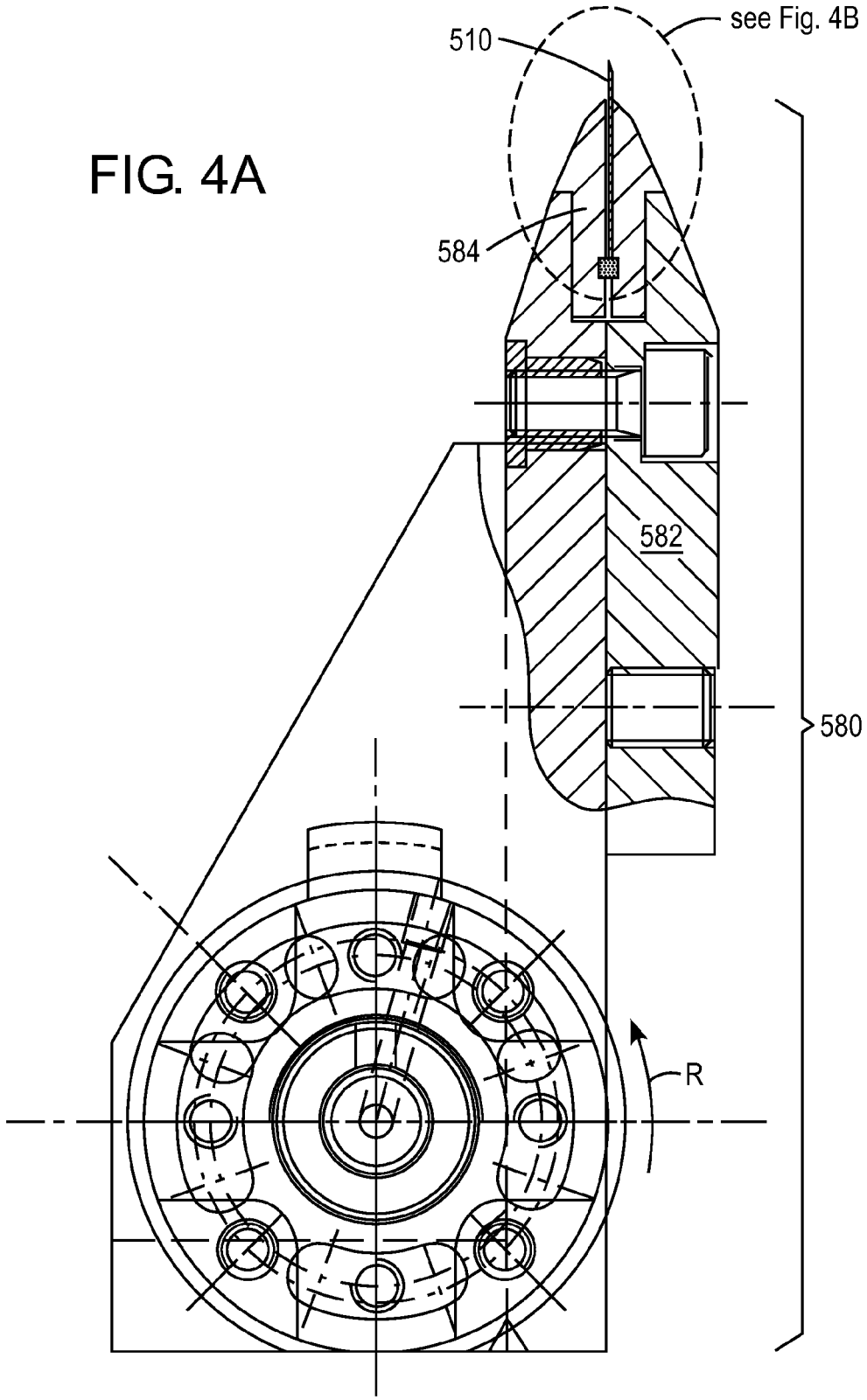
FIG. 4A is a magnified, partial side views along section A-A of FIG. 3
Figure 4B:
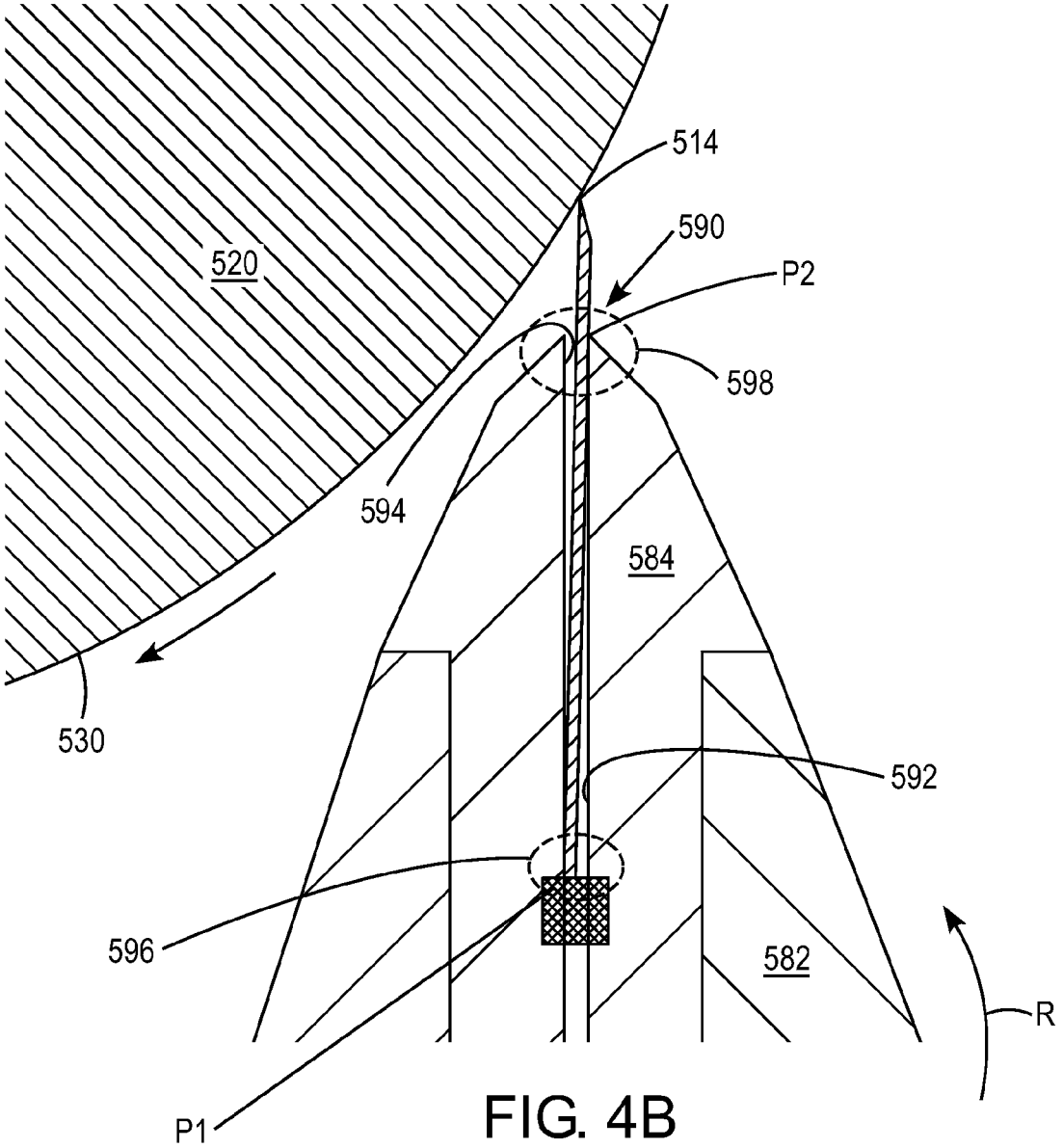
FIG. 4B is a magnified view of a portion of FIG. 4A showing the doctor blade seated in the blade holder and urged into contact with the rotating cylinder.

As seen in FIGS. 3 and 4A and 4B, blade holder 580 extends longitudinally in a common direction with the blade path as it traverses the rotating cylinder 520 in a desired orientation for doctoring. It will be understood that the rotating cylinder depicted in FIGS. 3 and 4A-B can be replaced by other surfaces to be doctored, such as a surface on a shifting belt. In the illustrated example, the blade holder 580 is oriented, relative to the rotating cylinder 520, in the axial direction from the first axial end 524 to the second axial end 526. The blade holder 580 has a blade back 582 in a first portion and a blade seat 584 in a second portion. The blade seat 584 releasably holds a portion of the doctor blade 510, e.g., an intermediate portion 512 of the doctor blade 510, with a suitable orientation with respect to the surface being doctored 530 to apply or manipulate the coating or other material in the doctoring process.

In an exemplary embodiment and observable in cross-sectional view in FIGS. 4A and 4B, the blade seat 584 can incorporate a slit 590 with opposing surfaces 592,594. The intermediate portion 512 of the doctor blade 510 can be held in the blade seat 584 in a friction fit. The friction fit between the doctor blade 510 and the blade seat 584 is releasable. In one embodiment, a biasing system is incorporated into the doctor blade handling system. The biasing system can, for example, generate a reversible or removable rotational force (indicated by arrow R) on the blade holder 580 relative to its longitudinal axis.

Any mechanical or electrical apparatus internal or external to the blade holder 580 can be used in the biasing system to control the rotational position of the blade holder and can contribute to establishing the removable rotational force. As an example of a structure suitable for use in the biasing system, the rotational force can be associated with a spring incorporated into the interior of the blade holder or attached externally to the blade holder. When mounting the blade holder on its mounting axis, the spring can be attached such that threading the doctor blade into the blade seat requires rotation of the blade holder and tensioning of the spring. At least a portion of this tension remains present when the edge of the intermediate portion of the doctor blade is in contact with the surface being doctored.

In exemplary embodiments, the biasing system is capable of both applying and removing the bias urging the working edge 514 of the doctor blade 510 to the surface being doctored 530. Alternatively, separate systems can be utilized to provide biasing/unbiasing functions to the doctoring apparatus 500.

However established, a force originating with the contact of the working edge 514 of the doctor blade 510 to the surface being doctored 530 skews the doctor blade 510 in the slit 590. The skewed doctor blade 510 contacts a first of the opposing surfaces at a base 596 of the slit 590 and contacts a second of the opposing surfaces at a mouth 598 of the slit 590. In conjunction with the force-exerting contact between the working edge 514 of the doctor blade 510 to the surface being doctored 530, the two contact points P1,P2 establish a friction fit between the doctor blade 510 and the blade seat 584.

The friction fit is sufficient to prevent translational movement of the doctor blade 510 in the blade seat 584. As a result, when the friction fit is present, the doctor blade 510 will move in connection with any translational movement of the blade holder 580. When the force originating with the contact of the working edge 514 of the doctor blade 510 to the surface being doctored 530 is sufficiently reduced or removed, then the friction fit is reduced or removed and the doctor blade 510 and blade holder 580 can move independently. For example, relative to the blade path, the blade holder 580 reciprocates between a first position and a second position (an example of such first and second positions have been shown and described in connection with FIGS. 1A and 1B; in FIG. 3, the blade holder is in a first position) in the direction indicated by arrow M. An oscillation system 630 operably connected to the blade holder 580 causes the reciprocating translation motion. With the biasing system in operation to produce a friction fit, when moving the blade holder 580 from the first position to the second position (which corresponds with advancing the doctor blade 510 along the blade path) the doctor blade 510 will correspondingly move with the blade holder 580. With the biasing system operating to reduce or remove the friction fit, when moving the blade holder 580 from the second position to the first position the doctor blade 510 can slide in the seat 590 while the blade holder 580 moves. If the doctor blade 510 is restrained from moving during the return reciprocation of the blade holder 580, then the doctor blade 510 moves relative to the blade holder 580 and repetition of this step-wise movement indexes the doctor blade 510 to advance along the blade path. The indexing is periodic and based on the frequency the blade holder 580 reciprocates between the first position and the second position.

In summary, in an indexing mode the sequence of operations to index the doctor blade includes: (i) biasing the blade holder to be in force-exerting contact with a surface to be doctored, wherein the force imparted to the doctor blade frictionally engages the doctor blade with a seat of the blade holder, (ii) translating the blade holder in a first direction from a first position to a second position to pay out the elongated, continuous doctor blade from a supply source and to advance the doctor blade along the blade path, (iii)

clamping the elongated, continuous doctor blade in a clamp of a device, (iv) removing or lessening the biasing on the doctor blade to reduce or remove the friction fit between the doctor blade and the blade holder, (v) translating the blade holder in a second direction to slidably move the doctor blade in the seat of the blade holder as the blade holder moves from the second position toward the first position. The biasing is then reapplied and the sequence repeated in step-wise movement to index the doctor blade to advance along the blade path.

In addition to the indexing mode described above, the doctor blade handling system in FIG. 3 can operate in a speed mode. In the speed mode, the doctor blade 510 is advanced along the blade path by operation of the pneumatic blade advancing device 700 and without the translational movement of the blade holder 580. Advancing of the doctor blade 510 occurs when the bias on the doctor blade 510 has been removed or sufficiently reduced to remove or sufficiently reduce the friction fit of the doctor blade 510 doctor blade 510 in the blade seat 584 to allow relative motion between the doctor blade 510 and the blade holder 580 in the direction of the blade path. Once the friction fit is removed or sufficiently reduced, the pneumatic blade advancing device 700 operates to advance (relative to at least one of, if not both, the blade holder 580 and the surface to be doctored 530) the doctor blade 510 a desired length, which is typically at least equal to or greater than an axial length of the surface being doctored 530 (an example of a typical length is about 2 meter). The pneumatic blade advancing device 700 operates to advance the doctor blade 510 by, for example, rotating a powered roller that is in contact with the doctor blade with sufficient force to overcome any residual force in the friction fit between the doctor blade 510 and the blade seat 584 and translates the doctor blade 510 as the powered roller rotates for a desired time at a desired speed or for a desired number of rotations (additional description of the structure and operation of the pneumatic blade advancing device 700 is set forth in further detail below in connection with the description of FIGS. 5A and 5B). Once the doctor blade 510 is advanced as necessary or desired, the friction fit between the doctor blade 510 and the blade seat 584 is restored by reapplying a bias to the doctor blade 510 and doctoring operations can resume.

An example of the sequence of operations to advance the doctor blade 510 in the speed mode includes: (i) stopping the feeding of product on the rotating cylinder 520 (or the like), (ii) stopping the reciprocation of the blade holder 580, (iii) removing or lessening the biasing on the doctor blade 510 to reduce or remove the friction fit between the doctor blade 510 and the blade seat 584, (iv) placing the blade clamp 810 and the blade cutter 820 (when present) in an open position, (v) placing the pneumatic blade advancing device 700 in a closed position, (vi) activating the powered roller 720 of the pneumatic blade advancing device 700 to move the doctor blade 510 though the blade seat 584 of the blade holder 580 a length sufficient to position a new portion of doctor blade 510 to be in contact with the surface to be doctored 530, (vii) placing the blade clamp 810 and the blade cutter 820 (when present) in a closed position to one or more clamp, cut and discharge the doctor blade 510 into the collection device, and (viii) placing the pneumatic blade advancing device 700 in an open position, and (when present) placing the blade clamp 810 and the blade cutter 820 in an open position, (ix) biasing the doctor blade to establish a sufficient friction fit between the doctor blade 510 and the blade seat 584 to stationarily position the doctor blade 510 in the blade seat 584, (x) activating the reciprocation of the blade holder 580, and (xi) feeding product on the rotating cylinder 520 (or the like). Both before and after the speed mode, the doctor blade handling system can operate in the indexing mode to doctor material on the surface to be doctored 530 while replacing worn doctor blade 510 by intermittent indexed feeding with the oscillation system 630.

The speed mode can advance any length of doctor blade 510 by increasing the length of time the pneumatic blade advancing device 700 is operated while the doctor blade 510 is unbiased or has sufficiently reduced bias. Also an alternative speed mode can combine translational movement of the blade holder 580 with the above speed mode. However, less time is needed to advance the doctor blade 510 in the speed mode than in the alternative speed mode. Also, there may be instances, such as a damaged doctor blade, where the doctor blade needs to be advanced a length that is greater than the indexing length before a suitable doctor blade is in place for doctoring operations, in which case the added translational movement may not be suitable or may not add to the efficient operation of the doctor blade handling system.

Returning to the translational movement of the blade holder 580, in the first position the blade holder 580 is operably proximate a portion of a surface to be coated 530 with the blade holder 580 positioned axially between the first and second axial ends 524, 526 of the rotating cylinder 520. In the second position, the blade holder 580 has moved downstream (relative to the direction of motion of the blade path from supply source 550 to discharge end 560). In the exemplary embodiment in FIG. 3, when the blade holder 580 moves in the downstream direction, the second position of the blade holder 580 is closer to the discharge end 560 than is the first position. Alternatively, in the second position the blade holder 580 is proximate the circumferential surface of the rotating cylinder 520 with at least a portion of the blade holder 580 positioned axially outside one of the first and second axial ends 524,526 of the rotating cylinder 520.

Returning to the oscillation system 630, in the exemplary embodiment of FIG. 3 the oscillation system 630 includes an electric drive system with an electric gear motor 632 provided with a crank throw 634 and a connecting rod 636. This connecting rod 636 is directly connected to the blade holder 580. Similar to the embodiment shown in FIGS. 1A and 1B, when electric gear motor 532 in FIG. 3 operates, the crank throw 634 rotates and the connecting rod 636 reciprocates, causing reciprocating motion in the connected blade holder 580 and its associated features.

Figure 5A:
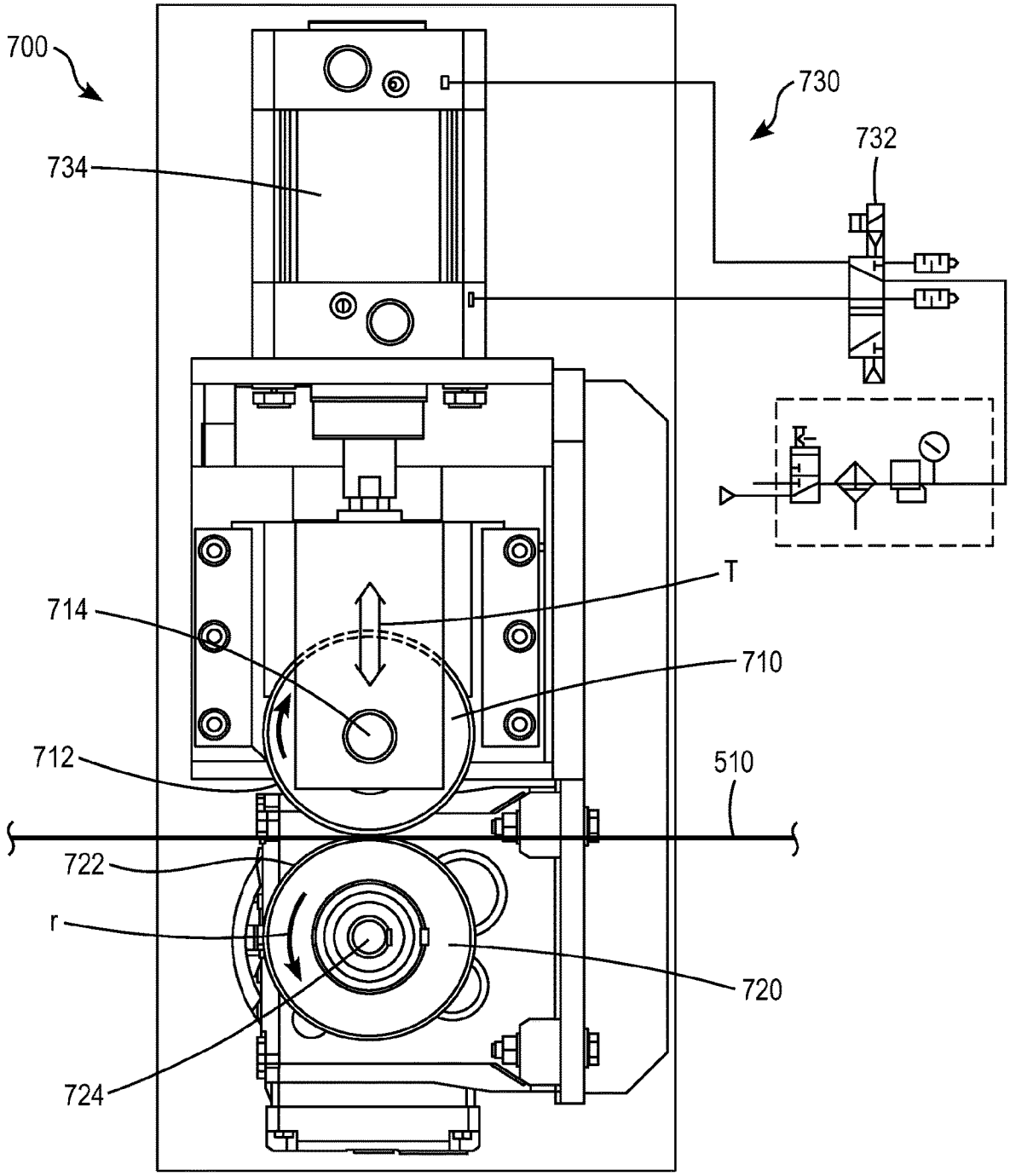
FIGS. 5A and 5B are both a schematic illustration, in cut-away view, of an exemplary embodiment of a high speed device in the closed position (FIG. 5A) and the open position (FIG. 5B).
Figure 5B:
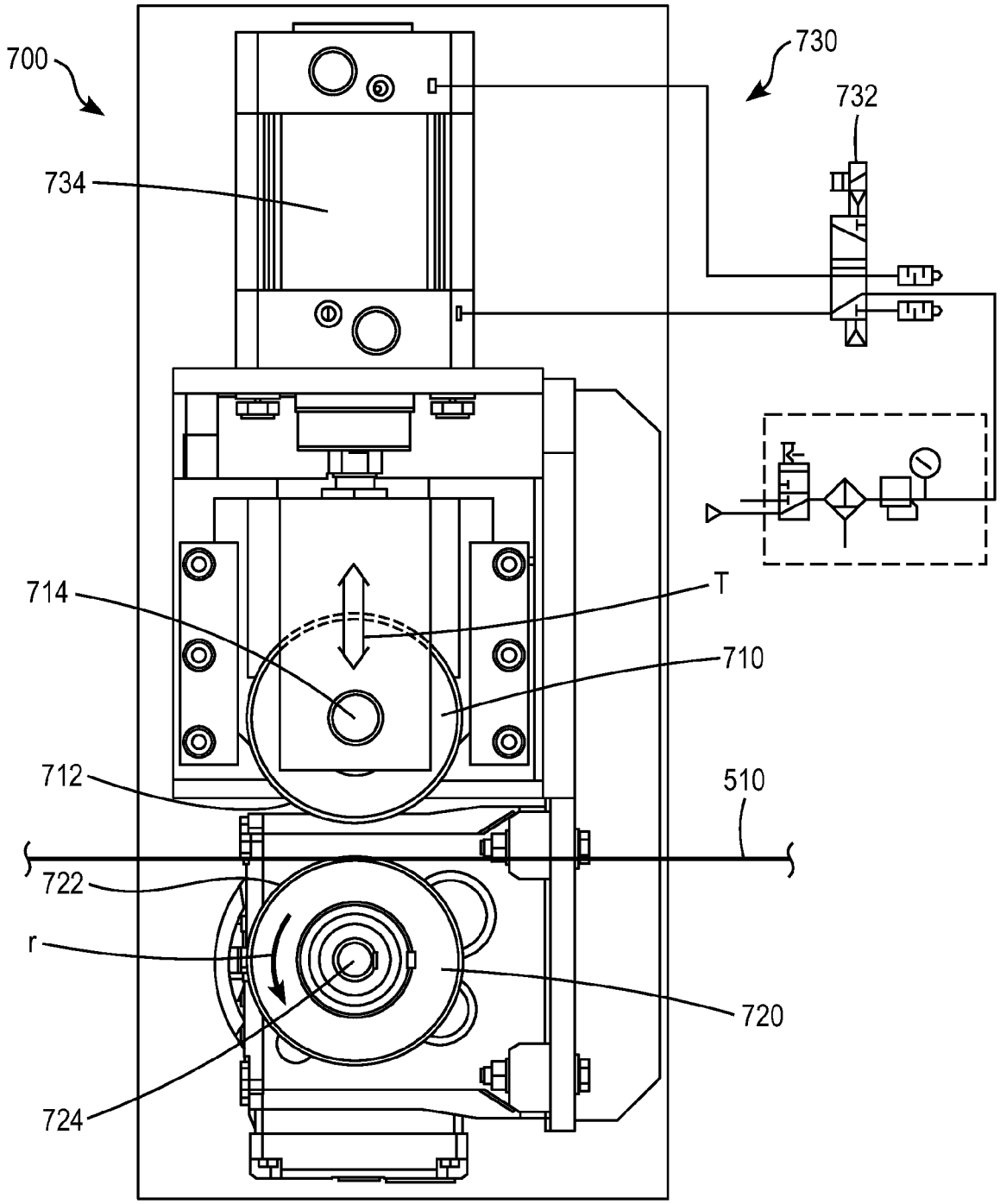

An exemplary embodiment of a pneumatic blade advancing device 700 is illustrated in FIGS. 5A and 5B. The pneumatic blade advancing device 700 includes an idler roller 710 and a powered roller 720. The relative motion translating (T) the idler roller 710 toward the powered roller 720 can be pneumatically actuated between a closed position and an open position. FIG. 5A illustrates the pneumatic blade advancing device 700 in a closed position. In the closed position, a surface 712 of the idler roller 710 and a surface 722 of the powered roller 720 contact surfaces of the doctor blade 510 and exert a pressure to the doctor blade 510. While in the closed position, the exerted pressure is sufficient to hold the doctor blade 510 substantially stationary, alternatively stationary, relative to an imaginary line extending between the axis of rotation 714 of the idler roller 710 and the axis of rotation 724 of the powered roller 720. Further, in the closed position there is sufficient friction between the surface 722 of the powered roller 720 and a surface of the doctor blade 510 so that, when the powered roller 720 rotates (r), the unbiased doctor blade 510 can be drawn longitudinally through the blade seat 584 and the doctor blade 510 advanced along the blade path. Typically, the friction between the surface 722 of the powered roller 720 and a surface of the doctor blade 510 is not sufficient to longitudinally draw the biased doctor blade 510 through the blade seat 584 when the powered roller 720 rotates (r).

FIG. 5B illustrates the pneumatic blade advancing device 700 in an open position. In the open position, the surface of at least one of the idle roller 710 and the powered roller 720 is spaced apart from the surfaces of the doctor blade 510. While in the open position, rotation (r) of the powered roller 720, by itself, is generally not sufficient to longitudinally draw the biased doctor blade through the blade seat 584.

Positioning and relative translation of at least one of the idle roller 710 and the powered roller 720 of the pneumatic blade advancing device 700 are made by a pneumatic circuit 730 that includes pneumatic valve 732 that supplies pneumatic fluid alternately to different sides of a pneumatic cylinder operably connected to at least one of the idle roller 710 and the powered roller 720.

A pneumatic multi-position cylinder unit with a blade clamp and a blade cutter can optionally, but is not required to be, included in the doctoring apparatus 500 shown and descried in connection with the embodiment in FIG. 3. When a pneumatic multi-position cylinder unit is not present, the doctor blade 510 that advances down the blade path past the pneumatic blade advancing device 700 can be collected in a collection device positioned at the discharge end 560. The collection device illustrated in FIG. 3 is a box 562, but can be any container as long as it is capable of being suitably positioned and has a suitably size and capacity to hold the doctor blade 510 that indexingly advances from the discharge end 560 of the doctor blade handling system 540.

Figure 6:
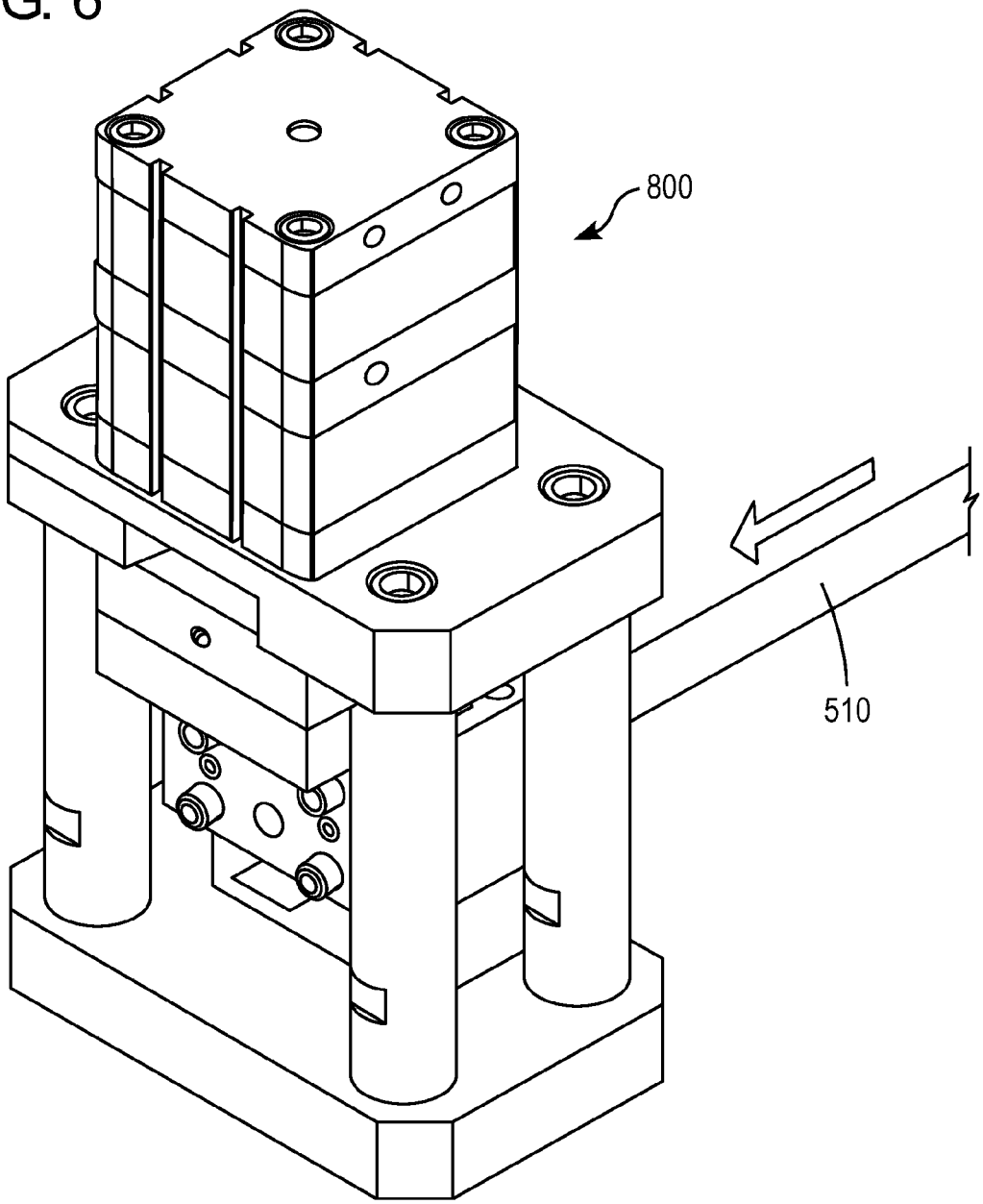
FIG. 6 is a perspective view of another exemplary embodiment of a blade clamp and blade cutter system to clamp and cut a doctor blade.

If included, a pneumatic multi-position cylinder unit with a blade clamp and a blade cutter can be the same as or similar to that shown and descried in connection with the embodiment in FIGS. 1A-B and 2. Alternatively, the pneumatic multi-position cylinder unit can be the same as or similar to that shown in FIGS. 6, 7A-B, 8A-B, and 9A-B. FIG. 6 is a perspective view of an exemplary embodiment of a pneumatic multi-position cylinder unit 800 with a blade clamp and blade cutter system to clamp and cut a doctor blade 510; FIGS. 7A-B, 8A-B, and 9A-B shows details of an embodiment of a pneumatic multi-position cylinder unit 800 with a blade clamp 810 and a blade cutter 820 in cut-away, side views in different operating positions in the operating sequence.

Figure 7A:
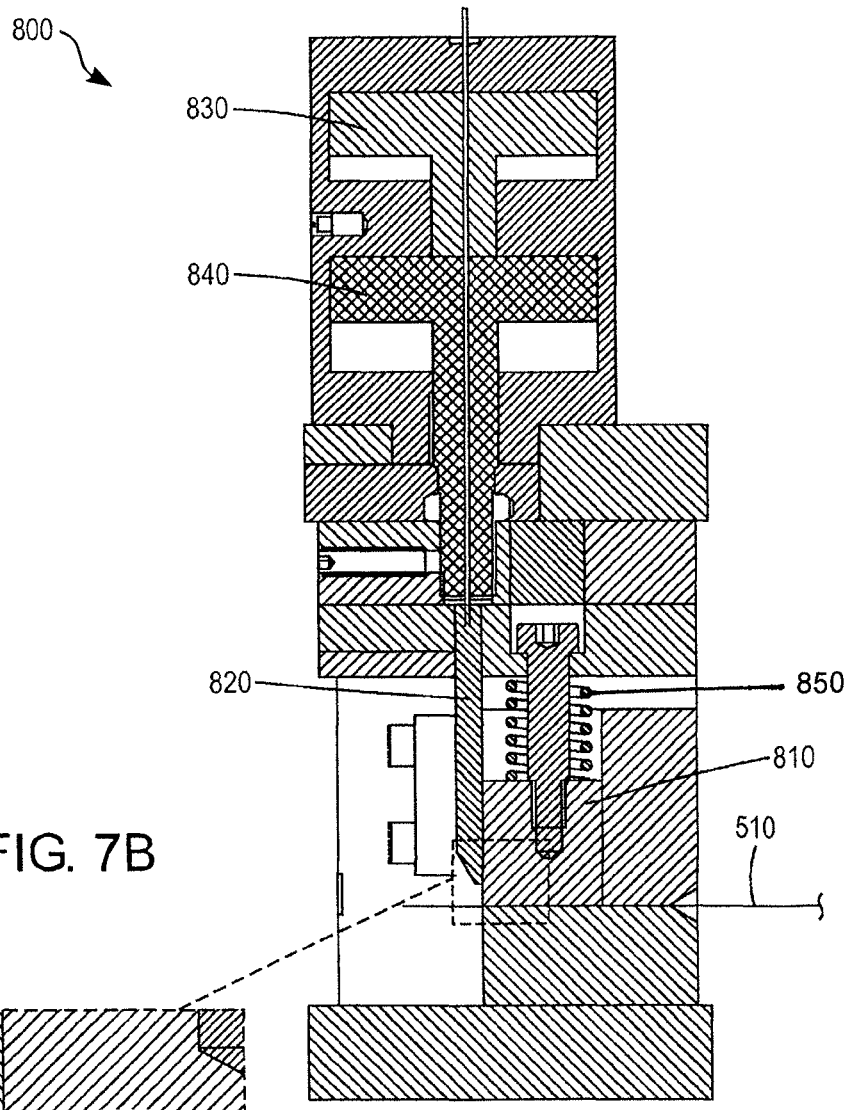
FIGS. 7A and 7B illustrate, in schematic, cut-away view, a first position of the blade clamp and blade cutter system in FIG. 6.
Figure 7B:
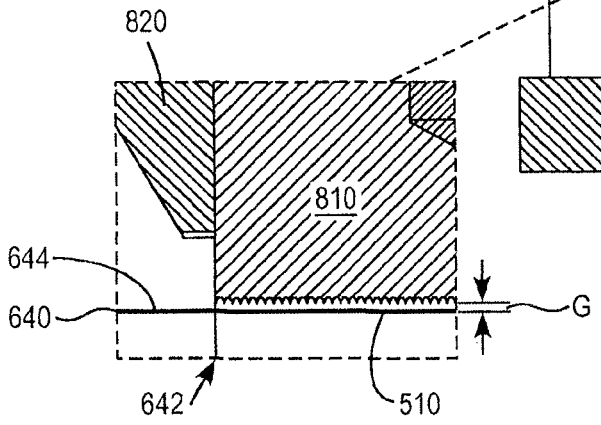

FIGS. 7A-B show the pneumatic multi-position cylinder unit 800 with both the blade cutter 820 retracted from the cutting zone 642 and the blade holder 810 retracted away from the doctor blade 510. Here, the pneumatic piston head 830 for the blade clamp 810 and the pneumatic piston head 840 for the blade cutter 820 are both in the unactuated position. In the unactuated position in this embodiment, both the pneumatic piston head 830 for the blade clamp 810 and the pneumatic piston head 840 for the blade cutter 820 are positioned, relative to the respective cavity in which the piston head translates, at a position that is furthest from the side of the cavity that includes a channel for a piston rod of the piston head. With respect to the blade clamp 810, the retracted position removes a positional force from a biasing device, such as the spring 850, so that the blade clamp 810 is spaced from the doctor blade 510 to form a gap (G). The gap (G) exists between the blade holder 810 and the surface of the doctor blade 510. Typical sizes for the gap (G) are 0.25 mm to 2.0 mm, alternatively 0.5 mm to 2.0 mm or 0.5 mm to 1.5 mm. In this position, the pneumatic multi-position cylinder unit 800 does not interfere with movement through the gap (G) of the doctor blade 510 by the doctor blade handling system 540 as the doctor blade 510 is advanced along the blade path. With respect to the blade cutter 820, the retracted position positions the blade cutter spaced apart from doctor blade 510 in area of the cutting zone 642. The blade cutter 820 is positioned in the spaced apart spatial relationship by suitable means, such as by being mechanically connected to the retracted pneumatic piston head 840 for the blade cutter 820 or by a biasing device, such as a spring, that urges the blade cutter to the spaced apart position.

Figure 8A:
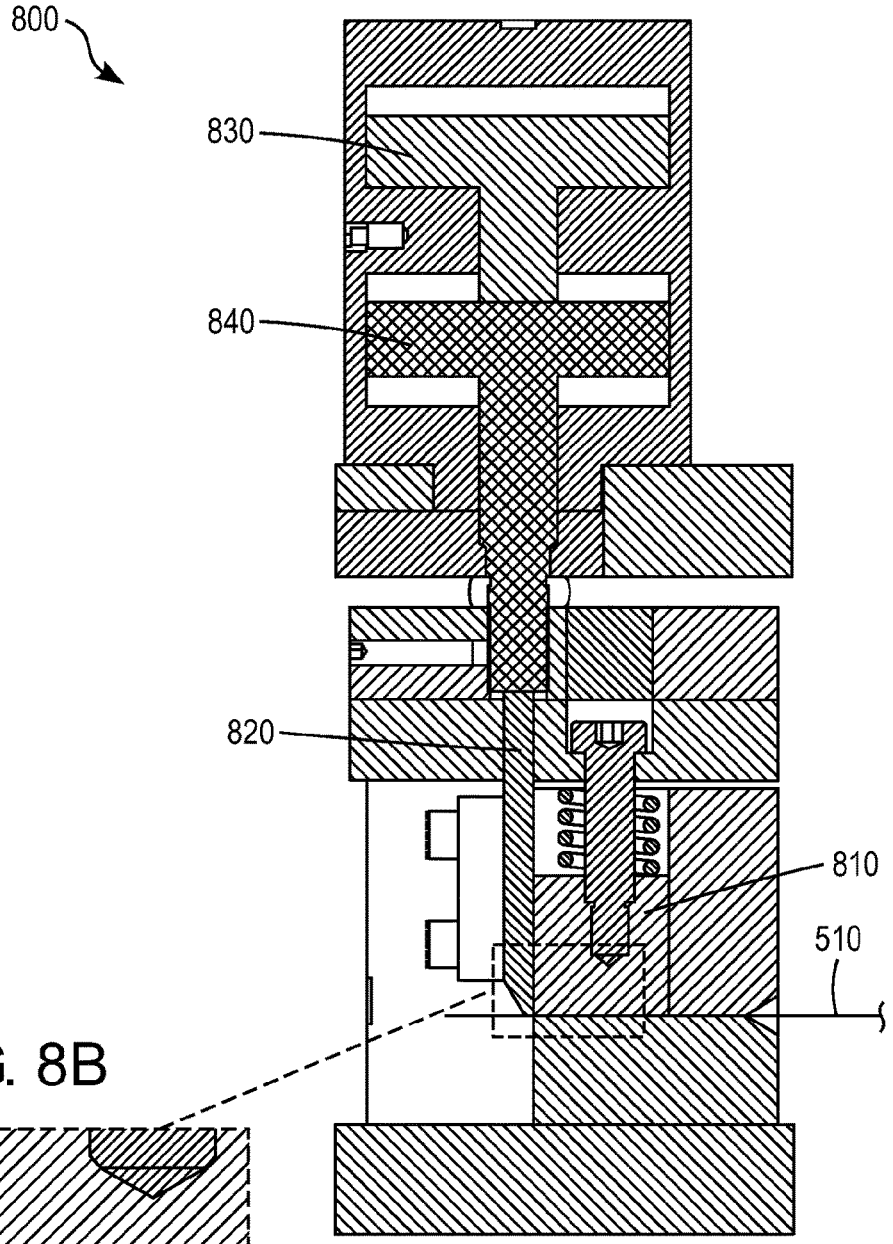
FIGS. 8A and 8B illustrate, in schematic, cut-away view, a second position of the blade clamp and blade cutter system in FIG. 6.
Figure 8B:
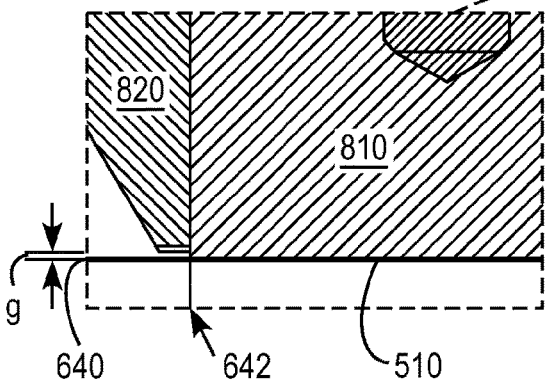

FIGS. 8A-B show the pneumatic multi-position cylinder unit 800 with the blade holder 810 engaged against the doctor blade 510. Here, the pneumatic piston head 830 for the blade clamp 810 is in a fully actuated position in that the piston head is positioned, relative to the respective cavity in which the piston head translates, at a position that is closest from the side of the cavity that includes a channel for a piston rod of the piston head. In this position, i.e., the clamp actuated position, a positional force is applied to the biasing device, such as the spring 850, so that the blade clamp 810 is urged toward the doctor blade 510 to eliminate the gap (G). Contact between the blade clamp 810 and the surface of the doctor blade interferes with movement of the doctor blade 510 by the doctor blade handling system 540 as the doctor blade 510 is advanced along the blade path. Also, the blade cutter 820 is partially advanced in the cutting zone 642 (relative to the retracted position in FIGS. 7A-B) and is spaced apart from the doctor blade 510 by a gap (g). Here, the pneumatic piston head 840 for the blade cutter 820 is in an intermediate position (relative to the translational limits of the piston head within the respective cavity) that is neither a fully actuated position nor a fully unactuated position. However, this intermediate position is sufficiently moved from the unactuated position (as in FIGS. 7A-B) that the cutter blade has moved in the cutting zone 642 some of the distance towards contact with the doctor blade 510.

Figure 9A:
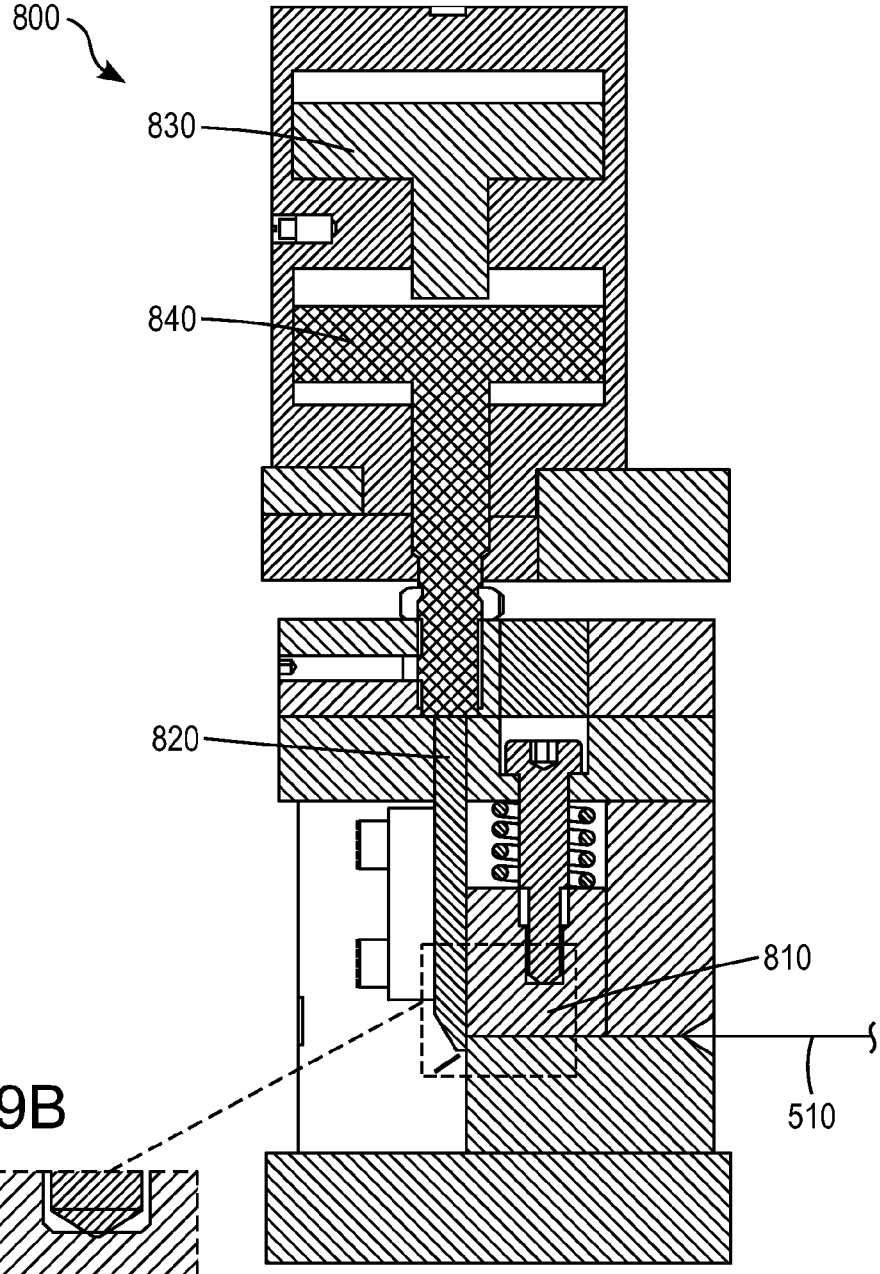
FIGS. 9A and 9B illustrate, in schematic, cut-away view, a third position of the blade clamp and blade cutter system in FIG. 6.
Figure 9B:
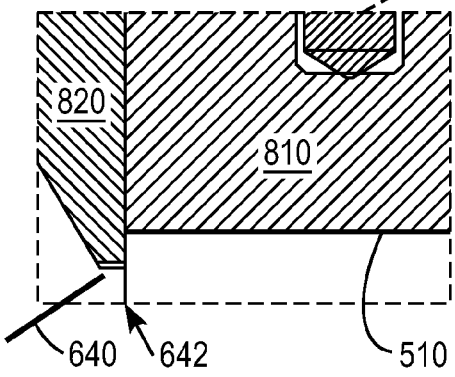

FIGS. 9A-B show the pneumatic multi-position cylinder unit 800 with the blade holder 810 engaged against the doctor blade 510 and with the blade cutter 820 in an actuated position. Here, the pneumatic piston head 830 for the blade clamp 810 has not moved from the position associated with FIGS. 8A-B, i.e., is still in the clamp actuated position, but the pneumatic piston head 840 for the blade cutter 820 has continued moving (relative to the cavity) from the intermediate position to an actuated position to advance the cutting blade 820 in the cutting zone 642 (relative to retracted position when unactuated as in FIGS. 7A-B) through the blade path such that the blade cutter 820 has cut the portion 640 of the doctor blade 510 that extends past the cutting zone 642. Also in the illustrated position, the pneumatic multi-position cylinder unit 800 still interferes with movement of the doctor blade 510 by the doctor blade handling system 540 as the doctor blade 510 is advanced along the blade path because the blade holder 810 is still engaged against the doctor blade 510.

The arrangement to operate the blade clamp 810 and the blade cutter 820, for example the arrangement of pneumatic valves and lines, are not shown in FIGS. 7A-B, 8A-B and 9A-B, but an arrangement similar to that shown and described in connection with FIGS. 1A and 2 can be used or adapted by one of ordinary skill in the art to function with the arrangement in FIGS. 6, 7A-B, 8A-B and 9A-B.

Exemplary embodiments of a pull through doctor blade handling system 540 also include a sensor 900 proximate the blade holder 580 and a control unit 1000 operably connected to the oscillation system 630, a pneumatic blade advancing device 700, a pneumatic multi-position cylinder unit 800 (if present), and the sensor 900. An example of a sensor 900 is an inductive switch. In exemplary embodiments, the sensor 900 discriminates between the blade holder 580 located in the first position and the blade holder 580 not in the first position or, for example, located in the second position.

The pneumatic blade advancing device 700 and the blade clamp 810 (if present) are opened and closed in timed sequence with reciprocation of the blade holder 580 to achieve longitudinal shifting of the doctor blade 510 in a selected direction across the doctored surface, from supply source 550 to discharge end 560. Additionally, the blade clamp 810 and blade cutter 820 (if present) can be used to provide a further clamping of the doctor blade 510 and to cut the worn doctor blade. The blade cutter 820 can also be used to drive any cut-off portion 640 of the doctor blade into the collection device 562.

The control unit 1000 coordinates the operation and sequence of the oscillation system 630, the blade holder 580, a pneumatic blade advancing device 700, and a pneumatic multi-position cylinder unit 800 (if present) based on position information communicated from the sensor 900. The operations and sequence include one or more of:

(i) biasing the blade holder 580 to place a portion of the doctor blade 510 in force-exerting contact with a surface to be doctored 530, (ii) translating (M) the blade holder 580 in a first direction from a first position to a second position, (iii) operating the pneumatic blade advancing device 700 to clamp the elongated, continuous doctor blade 510 in a stationary position relative to the blade path, (iv) unbiasing the blade holder 580 to reduce or remove the force-exerting contact between the doctor blade 510 and the surface to be doctored 530, and (v) operating the pneumatic blade advancing device 700 to advance the elongated, continuous doctor blade 510 relative to a fixed point along the blade path (vi) translating (M) the blade holder 580 from the second position to the first position.

Several functions of the doctoring apparatus are enabled by the operations and sequencing coordinated and controlled by the control unit 1000. For example, biasing the blade holder to be in force-exerting contact with a surface to be doctored imparts a force to the doctor blade that frictionally engages the doctor blade with a seat of the blade holder. An example of this is shown and described in connections with FIGS. 4A and 4B. Also, translating (M) the blade holder 580 in a first direction from a first position to a second position pays out the elongated, continuous doctor blade 510 from a supply source 550 and to advance a portion of the doctor blade 510 into a clamping zone of a pneumatic blade advancing device 700. Operation of the pneumatic blade advancing device 700 clamp the elongated, continuous doctor blade 510 in a stationary position relative to the blade path, an example of which is a stationary position relative to an imaginary line extending between the axis of rotation 714 of the idler roller 710 and the axis of rotation 724 of the powered roller 720. In addition, translating (M) the blade holder 580 in a second direction slidably moves the doctor blade 510 relative to the seat 584 of the blade holder 580 as the blade holder 580 moves from the second position toward the first position. In this way, the doctor blade 510 is longitudinal shifted in a selected direction across the surface to be doctored 530.

In addition to the above operations and sequences (i) to (v), after the doctor blade 510 is unbiased and before the doctor blade 510 is rebiased and with the pneumatic blade advancing device 700 in the actuated to clamp position, the powered roller 720 can be rotated to move the doctor blade 510 along the blade path by a length that is greater than just the oscillation distance of the blade holder 580 between the first position and the second position. For example, the powered roller 720 can be rotated in direction of rotation (r) a plurality of full or partial revolutions and, because the doctor blade is unbiased and can be drawn through the blade seat 584, the doctor blade 510 will advance along the blade correspondingly to the rotation of the powered roller 720. The sequencing of this operation in the overall operation of the doctoring apparatus and the timing and amount of rotation of the powered roller 720 is controlled and coordinated by the control unit 1000. In this manner, any length of doctor blade 510 can be programmed to be the indexing length when the doctor blade is advanced along the blade path and not just lengths associated with the oscillation distance between the first position and the second position. Preferably the indexing length is a length that represents the axial length of the surface to be doctored 530 or the axial length of the rotating cylinder 520 or is minimally one of these lengths.

In addition to the above operations and sequences, the control unit 1000 can optionally coordinate (when present) the operations and sequences of the pneumatic multi-position cylinder unit 800 to include:

(a) moving the blade clamp 110 to the clamping position, (b) cycling the blade cutter 120 between the open position and the cutting position, (c) moving the blade clamp 110 to the open position.

The operations and sequences (a) to (c) of the pneumatic multi-position cylinder unit 800 can occur at any point in the operation and the sequence that is after the blade holder 580 is translated (M) in a first direction from a first position to a second position.

In a more detailed description of the operation (i) to (v) of the embodiment in FIG. 3, the blade holder 580 is biased against the surface to be doctored 530 and the doctor blade is friction fit in the blade seat 584. The blade holder shifts from the first position to the second position (the second position downstream in a direction of the blade path from the first position) and sensor 900 communicates positional information of the blade holder 580 to the control unit 1000, which is connected to the control valving of the pneumatic blade advancing device 700, e.g., pneumatic circuit 730, and is optionally connected (if present) to the solenoid of the pneumatic valves 202,204 of the pneumatic multi-position cylinder unit 800. In the illustrated configuration in FIGS. 3 and 5A-B, first idler roller 710 is translated then powered roller 720 is operated. As a consequence of this sequencing, the clamping of the blade is first achieved, before the pneumatic blade advancing device 700 is actuated. Typically, actuation of the pneumatic blade advancing device 700 cycles from an unclamped position to a clamped position and, at a later time, a reverse actuation of the pneumatic blade advancing device 700 returns the idler roller 710 and powered roller 720 to the unclamped position. While still clamped, the doctor blade 510 is unbiased and then the blade holder 580 is shifted in the opposite direction and back to the first position. Because the doctor blade 510 is prevented from moving by the still actuated to clamp pneumatic blade advancing device 700 (with or without the assistance of rotation (r) of the powered roller 720), the shifting of the blade holder causes the doctor blade 510 move in the blade seat 584 relative to the blade holder 580. Additionally, the powered roller 720 can be rotated additional revolutions to draw additional length of doctor blade 510 from the supply source 550 into and/or past the blade holder 580 or to advance the doctor blade 510 an additional distance along the blade path. Once returned to the first position, the sensor 900 updates the control unit 1000, which operates the pneumatic blade advancing device 700 in a reverse actuation that returns the idler roller 710 and power roller 720 to the unclamped position. When the next stroke of the oscillation system 630 occurs, the blade path is again open and the blade holder 580 will move again to the second position while the doctor blade 510 is biased against the surface to be doctored 530 and the doctor blade 510 that is friction fit in the blade seat 584 will be pulled forward on the blade path by the forward movement of the blade holder 580. In this way, the doctor blade 510 is incrementally shifted longitudinally across the cylinder 520 from a supply source 550 to a discharge end 560.

During doctoring operation, the blade holder 580 is oscillated by the oscillation system, and the idler roller 710 and powered roller 720 (and the optional blade clamp 810 and blade cutter 820, if present) are employed in timed sequence with this oscillation to shift the doctor blade 510 longitudinally and in an indexed-like fashion across the surface of the cylinder 520, with doctor blade 510 being gradually pulled from supply source 550 and cut-off by blade cutter 820 and collected in collection device, such as box 562. The handling system allows for the continuous or nearly continuous supply and disposal of the doctor blade.

When a first doctor blade 510 has been passed through the doctor blade handing system 540 and the trailing end of the doctor blade leaves the supply source 550, that supply source 550 is replaced by a new one containing a second doctor blade 510. This having been accomplished, the doctoring operation is momentarily interrupted, the idler roller 710 and powered roller 720 (and the optional blade clamp 810 and blade cutter 820, if present) are set to an open position and the leading end of the second doctor blade 510 is then advanced by the operator along the blade path through the idler roller 710 and powered roller 720 (and the blade clamp 810 and blade cutter 820, if present). The second doctor blade 510 is also attached to the blade holder 580. Then the doctoring operation is continued and, when full, the collection device containing the cut pieces of doctor blade is replaced by an empty one.

Additional information and description of the operation of optional pneumatic multi-position cylinder unit 800 according to (a) to (c) and its coordination by control unit 1000 is similar to that described in connection with the operation of the embodiment in FIGS. 1A and 1B.

Although the present invention has been described in connection with preferred embodiments thereof, it will be appreciated by those skilled in the art that additions, deletions, modifications, and substitutions not specifically described may be made without department from the spirit and scope of the invention as defined in the appended claims.

What is claimed is:

1. A pull through doctor blade handling system, comprising:

means for mounting a supply source for an elongated doctor blade;

a blade holder including a blade back with a seat for releasably holding a portion of the doctor blade;

a pneumatic multi-position cylinder unit including a blade clamp and a blade cutter;

a blade path for the doctor blade, the blade path running from proximate the means for mounting the supply source, through the blade holder, and to the pneumatic multi-position cylinder unit; and an oscillation system operably connected to the blade holder to translate the blade holder, relative to the blade path, reciprocatingly between a first position and a second position, wherein, in the first position, the blade holder is operably proximate a portion of a surface to be coated, and wherein, in the second position, the blade holder is closer to the blade clamp than in the first position.

2. The pull through doctor blade handling system of claim 1, wherein the pneumatic multi-position cylinder unit includes a first pneumatic cylinder system and a second pneumatic cylinder system, the first pneumatic cylinder system operable to change a position of a blade clamp between an open position and a clamping position and the second pneumatic cylinder system operable to change a position of a blade cutter between an open position and a cutting position.

3. The pull through doctor blade handling system of claim 2, comprising:

a sensor proximate the blade holder; and a control unit operably connected to the oscillation system, the pneumatic multi-position cylinder unit and the sensor, wherein the sensor discriminates between the first position of the blade holder and the second position of the blade holder and operably communicates position information to the control unit, wherein, based on position information communicated from the sensor, the control unit coordinates operation of the oscillation system, the control blade holder and the pneumatic multi-position cylinder unit:

(i) to move the control blade holder from the first position to the second position, (ii) to move the doctor blade clamping device to the clamping position, (iii) to cycle doctor blade cutting device between the open position and the cutting position, (iv) to move the blade holder from the second position to the first position and (v) to move the doctor blade clamping device to the open position, and wherein moving the blade holder from the second position to the first position slidably moves the blade holder from frictionally engaging a first portion of the doctor blade to frictionally engaging a second portion of the doctor blade.

4. The pull through doctor blade handling system according to claim 1, comprising an electric gear motor controlled by the control unit and connected to the blade holder by a crank throw and a connecting rod, wherein rotation of the electric gear motor moves the control blade holder from the first position to the second position.

5. A pull through doctor blade handling system, comprising:

means for mounting a supply source for an elongated doctor blade;

a blade holder including a blade back with a seat in which a portion of the doctor blade is positioned;

a pneumatic blade advancing device including an idler roller and a powered roller;

a pneumatic multi-position cylinder unit including a blade clamp and a blade cutter;

a blade path for the doctor blade, the blade path running from proximate the means for mounting the supply source, through the blade holder, through the pneumatic blade advancing device and to the pneumatic multi-position cylinder unit; and a biasing system operably connected to the blade holder to move an edge of the doctor blade seated in the blade holder between a biased position and an unbiased position, wherein, in the biased position, the edge of the doctor blade is in force-exerting contact with a surface to be doctored, wherein the idler roller and the powered roller are translatable, relative to each other, between a closed position in which surfaces of the idler roller and the powered roller exert a pressure to the doctor blade and an open position in which the surface of at least one of the idler roller and the powered roller is spaced apart from the doctor blade.

6. The pull through doctor blade handling system of claim 5, further comprising an oscillation system operably connected to the blade holder to translate the blade holder, relative to the blade path, reciprocatingly between a first position and a second position, wherein, in the first position, the blade holder is operably proximate a portion of a surface to be coated, and, in the second position, the blade holder is closer to the blade clamp than in the first position.

7. The pull through doctor blade handling system according to claim 6, comprising:

a sensor proximate the blade holder; and a control unit operably connected to the biasing system, the pneumatic blade advancing device, and the pneumatic multi-position cylinder unit and the sensor, wherein the sensor discriminates between the first position of the blade holder and the second position of the blade holder and operably communicates position information to the control unit, and wherein, based on position information communicated from the sensor, the control unit coordinates operation of the biasing system, the control blade holder, the pneumatic blade advancing device, and the oscillation system:

(i) to move the biasing system from the biased position to the unbiased position, (ii) to move the control blade holder from the first position to the second position, (iii) to move the pneumatic blade advancing device from the open position to the closed position, (iv) to move the control blade holder from the second position to the first position, and (v) to move the biasing system from the unbiased position to the biased position.

8. The pull through doctor blade handling system of claim 7, wherein the control unit also coordinates operation of the pneumatic multi-position cylinder unit to move the doctor blade clamping device to the clamping position, to cycle the doctor blade cutting device between the open position and the cutting position, and to move the doctor blade clamping device to the open position.

9. The pull through doctor blade handling system of claim 7, wherein the pneumatic blade advancing device in the closed position holds the doctor blade in a stationary position relative to the blade path while the doctor blade slidably moves in the seat of the blade holder as the blade holder moves from the second position to the first position.

10. The pull through doctor blade handling system of claim 5, wherein the pneumatic multi-position cylinder unit includes a first pneumatic cylinder system and a second pneumatic cylinder system, the first pneumatic cylinder system operable to change a position of a blade clamp between an open position and a clamping position and the second pneumatic cylinder system operable to change a position of a blade cutter between an open position and a cutting position.

11. A doctoring apparatus comprising the pull through doctor blade handling system of claim 1.

12. The doctoring apparatus of claim 11, wherein the supply source for the doctor blade is a blade cartridge and the doctor blade is coiled onto the blade cartridge.

13. The doctoring apparatus of claim 12, further comprising a container below a cutting zone of the blade cutter to collect cut off ends of the doctor blade.

14. The doctoring apparatus of claim 11, comprising:

a rotating cylinder with first and second axial ends and a circumferential surface, wherein the doctor blade extends past the first and second axial ends of the rotating cylinder, wherein the first position of the blade holder is proximate the circumferential surface of the rotating cylinder with the blade holder positioned axially between the first and second axial ends of the rotating cylinder, and wherein the second position of the blade holder is proximate the circumferential surface of the rotating cylinder with at least a portion of the blade holder positioned axially outside one of the first and second axial ends of the rotating cylinder.

* * * * *